US005868308A

United States Patent [19]

Briand

[11] Patent Number: 5,868,308

[45] Date of Patent: Feb. 9, 1999

[54] PAPERBOARD INTERLOCK ARRANGEMENT

[75] Inventor: Nathalie Briand, Paris, France

[73] Assignee: Riverwood International Corporation, Atlanta, Ga.

[21] Appl. No.: 817,681

[22] PCT Filed: Oct. 17, 1995

[86] PCT No.: PCT/GB95/02448

§ 371 Date: Jun. 3, 1997

§ 102(e) Date: Jun. 3, 1997

[87] PCT Pub. No.: WO96/12656

PCT Pub. Date: May 2, 1996

[30] Foreign Application Priority Data

Oct. 20, 1994 [GB] United Kingdom ..... 9421188

[51] Int. Cl.[6] ..... C65D 5/30

[52] U.S. Cl. ..... 229/198.2; 229/103.2; 493/137; 493/162

[58] Field of Search ..... 229/103.2, 198.2; 206/427; 493/137, 139, 140, 162

[56] References Cited

U.S. PATENT DOCUMENTS

| | | | |
|---|---|---|---|
| 4,433,807 | 2/1984 | Ganz | 229/198.2 |
| 4,458,836 | 7/1984 | Wood | 229/103.2 |
| 4,498,618 | 2/1985 | Sutherland | 229/198.2 |
| 4,577,799 | 3/1986 | Oliff | 229/198.2 |
| 4,679,725 | 7/1987 | Wilson | 229/103.2 |
| 5,004,147 | 4/1991 | Bienaime | 229/198.2 |
| 5,364,022 | 11/1994 | Ganz | 229/198.2 |
| 5,443,203 | 8/1995 | Sutherland | 229/198.2 |
| 5,472,138 | 12/1995 | Ingram | 229/198.2 |
| 5,588,586 | 12/1996 | Negelen | 229/198.2 |

FOREIGN PATENT DOCUMENTS 0371298 11/1989 European Pat. Off. .

*Primary Examiner*—Gary E. Elkins
*Attorney, Agent, or Firm*—Womble Carlyle Sandridge & Rice, PLLC

[57] ABSTRACT

An interlocking paperboard carton blank (10) is disclosed. The carton blank has at least one flap (19) projecting from a side dge of a first base panel (14), the flap having a leading portion (20) which is folded about a scored waist section score line (23) back onto the remainder of the flap to double the thickness of the flap. The leading portion of the flap includes at least one, and preferably two laterally projecting portions (21). The flap is inserted folded end first into at least one correspondingly positioned opening (27) defined in a second base panel (15) of the carton blank. The flap is passed into the opening until the two lateral projections of the folded flap are passed through the opening in the second base panel, whereupon the laterally projecting portions are constructed and arranged to be urged upwardly from the remainder of the flap so as to prevent withdrawal of the flap from the opening while the leading portion of the flap remains folded against the remainder of the flap to ensure that the flap has a doubled thickness in the interlocked base panels of the carton blank.

18 Claims, 6 Drawing Sheets

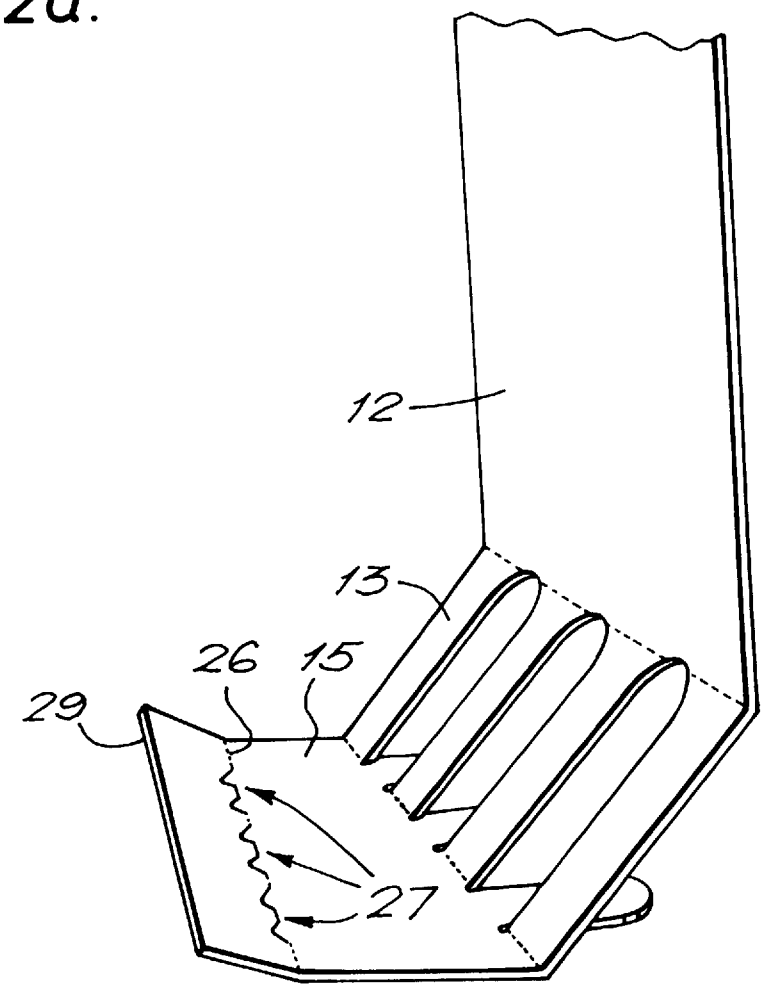
FIG. 2a.
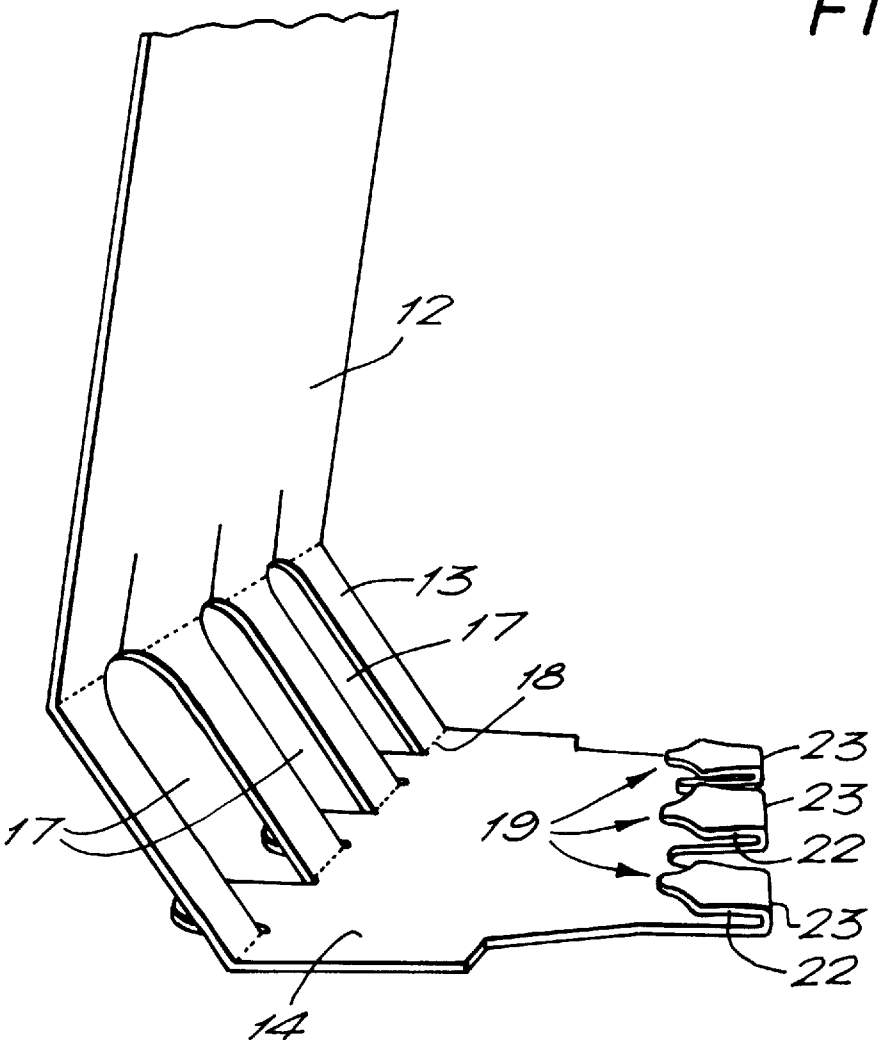

PAPERBOARD INTERLOCK ARRANGEMENT

This invention relates to interlock arrangements between two pieces of paperboard. In particular, but not exclusively the invention relates to such arrangements for securing the ends of a paperboard sleeve about an article or articles.

BACKGROUND OF THE INVENTION

According to the present invention an interlocking arrangement is provided for connecting the two end pieces of a paperboard carton blank having at least one flap projecting from a first one of the end pieces for cooperation with at least one respective opening defined in a end second end piece, of the paperboard carton blank the flap or flaps each having a leading portion spaced farthest from the remainder of the first end piece of the carton blank, behind which leading portion is a portion which projects laterally at least in one direction, the flap or flaps each being folded such that the leading portion and the laterally projecting portion are folded back on the rest of the flap, the flap is then inserted into its associated opening within the folded area or areas of the second piece first, so that when the laterally projecting portion of the flap passes through the opening it takes up a position clear of the edge of the opening, thereby preventing withdrawal of the flap while the leading portion thereof remains held by the opening. Such an interlocking arrangement can lie generally flat relative to the pieces of paperboard.

Preferably each flap has portions projecting laterally in both directions, the flap having a waisted section immediately behind the projecting portions, at which waist the flap is folded back along a straight line.

In preferred embodiments the opening comprises a single cut having two ends.

With chosen arrangements the laterally projecting portions are angled into the waist and into the leading portion. Also the maximum width across the laterally projecting portions of each flap is substantially the same as the maximum width of the associated opening. It is a preferred feature that the ends of the opening cut are angled in a manner corresponding to the angling, when folded back, of the laterally projecting portions towards the leading portion.

Preferably the flaps are dimensioned in such a way that during insertion of the leading portions do not clear the edges of the openings defined in the second end piece of the carton blank.

In certain embodiments the two pieces of paperboard are constituted by ends of a wraparound sleeve for containing one or more articles. Preferably two or more flaps are provided on one end of the sleeve and two or more corresponding openings are provided on the other end of the sleeve.

One preferred feature is that the ends of the openings are aligned on a fold line such that the free portion of the sleeve end hinges about the fold to in assist in the insertion of the flaps.

Another feature is that the fold comprises two end sections joined by a C-shaped cut extending away from the leading portion of the flap so that when folded back, a tab projects forwardly of the fold line.

Embodiments of the present invention will now be described in more detail in the accompanying drawings.

BRIEF DESCRIPTION OF THE DRAWINGS

FIGS. 2*a* and 2*b* show sequential perspective end views of the interlocking arrangement of FIG. 1 before and after connection.

DETAILED DESCRIPTION OF THE PREFERRED EMBODIMENTS

Figure 1:
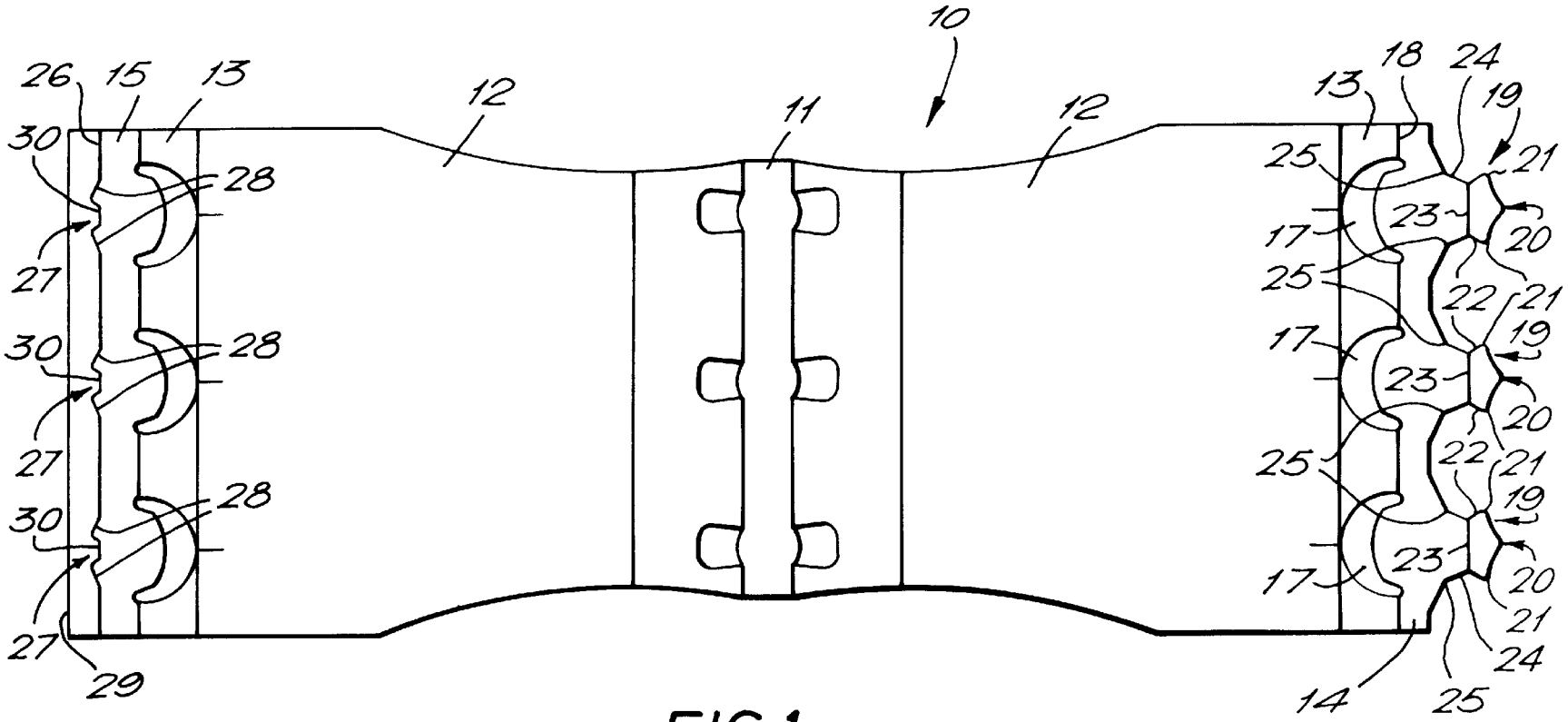
FIG. 1 shows a plan view of a carton blank incorporating an interlocking arrangement according to the present invention.

In FIGS. 1 to 4 there is shown a carton blank 10 for forming a sleeve-like carton for retaining three articles. The blank 10 has a top panel 11, main side panels 12, secondary side panels 13, a first base panel 14 and a second base panel 15. Cutouts 16 are provided in the top panel for locating the tops of the articles and cutouts 17 are provided in the secondary side panels for locating the bottoms of the articles. These features are well known in the art of carton manufacture.

The first base panel 14 is hingedly connected to its associated side panel 13 by means of a fold 18 which connects the ends of the cutouts 17. The base panel 14 is formed with three projecting flaps 19 each having a leading portion 20. Immediately behind the leading portions, on the side nearest the cutouts 17, are laterally projecting portions 21 which are angled laterally outwards at 22 from a waist section 23 in the form of a fold. Behind the waist, at 24, (FIG. 1) the flap again flares laterally towards the widest parts 25 of the flap 19. The widest parts 25 are just further from the waist 23 than are the widest parts of the laterally projecting portions 21, but are of a similar lateral width.

The second base panel 15 has a fold 26 interspersed with three openings 27 in the form of cuts. The openings 27 are located at positions which correspond to the positions of the flaps 19 on the first base panel 14 when the blank 10 is folded to make the carton. The lateral ends 28 of each opening 27 are angled towards the free edge 29 of the base panel 15 in the inward direction and then angled back toward the central portion 30 which lies along to the imaginary continuation of the fold 26. The lateral width of the openings are just marginally larger than the width of the laterally extending portions 21 of the flaps 19.

The connection of the interlocking arrangement will now be described. For the sake of convenience the connection of only one flap 19/with one opening 27 will be described. The first step is to bring the two base panels 14, 15 towards each other. The leading portion and laterally projecting portions of the flap 19 are folded upwards and back on the remainder of the flap about the waist fold 23. Also the end of the second base panel 15 is folded up slightly about the fold 26 thereby widening the opening 27. The flap 19, fold 23 first, is then inserted through the opening 27 laterally projecting portions 21 are just able to pass through the opening 27 and when they have cleared the angled ends 28 of the opening 27 they tend to spring upwardly thus preventing withdrawal of the flap 19 relative to the opening 27 because the leading edges, now facing backwards, of the laterally projecting portions 21 engage the angled ends 28 of the opening 27 and. At the same time the central portion 30 of the opening is located such that the leading portion 20 of the flap 19 does not clear the opening 27 and remains held below the second base panel 15. Further insertion of the flap is not possible because the ends of the opening 27 engage the widest parts 25 of the flap 19 at its hinged connection to the rest of the base panel 14.

When the arrangement is fully interlocked the interlock is generally flat. Such an interlock is, therefore, particularly suitable for use with flat-bottomed articles or containers, but can be used for other articles or containers.

Figure 6B:
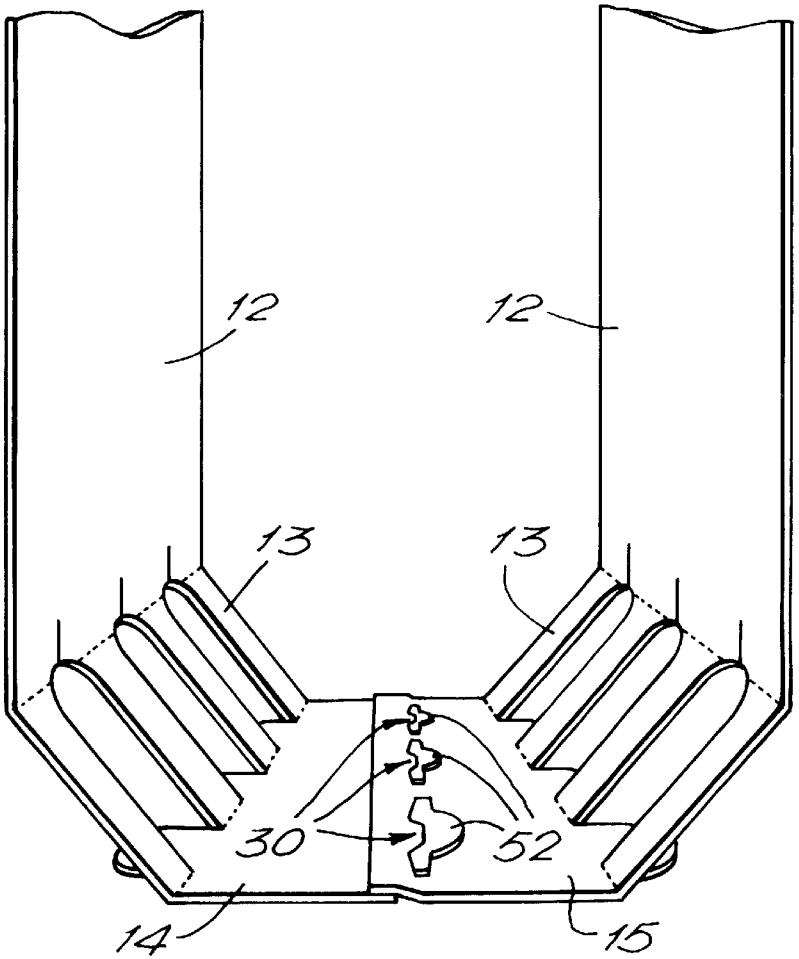
FIGS. 6*a* and 6*b* show sequential perspective end views of the interlocking arrangement of FIG. 5 before and after connection.
Figure 2B:
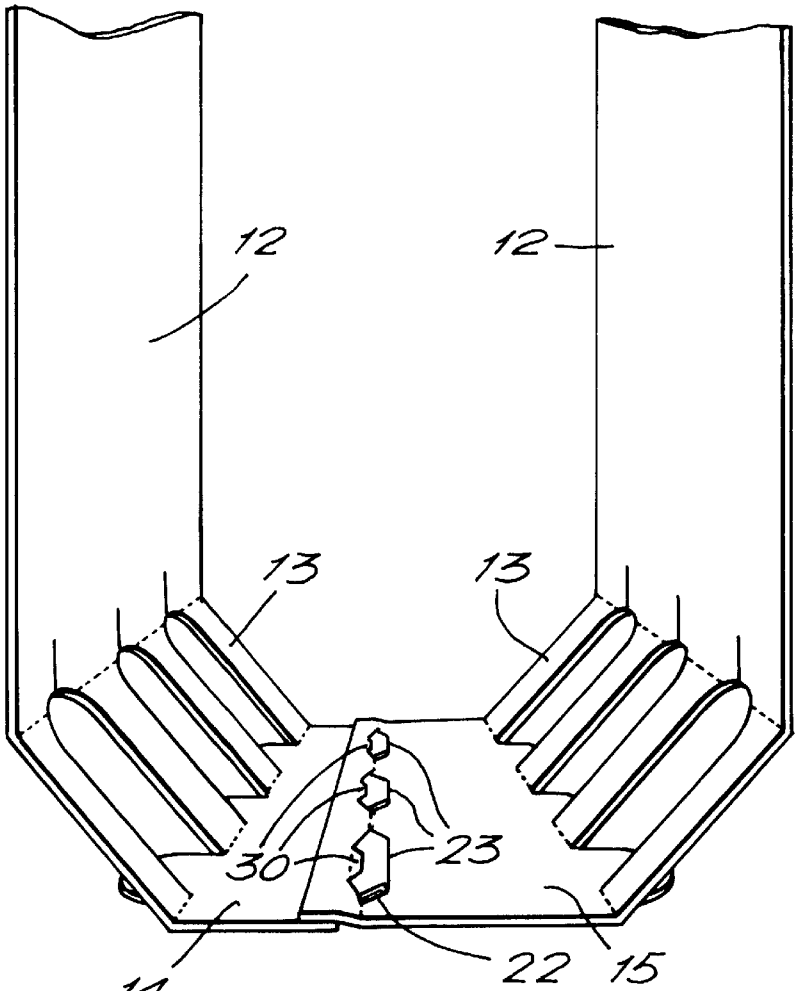
Figure 3:
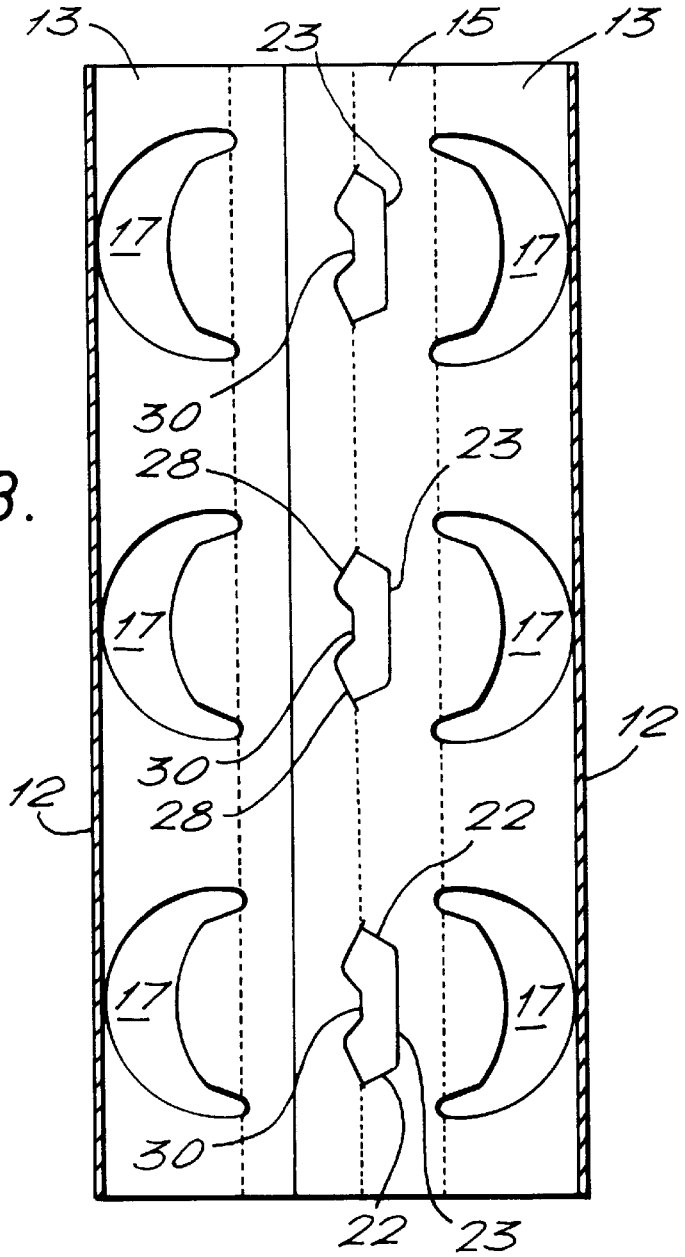
FIG. 3 is a cross-sectioned plan view of an assembled interlocking arrangement.
Figure 4:
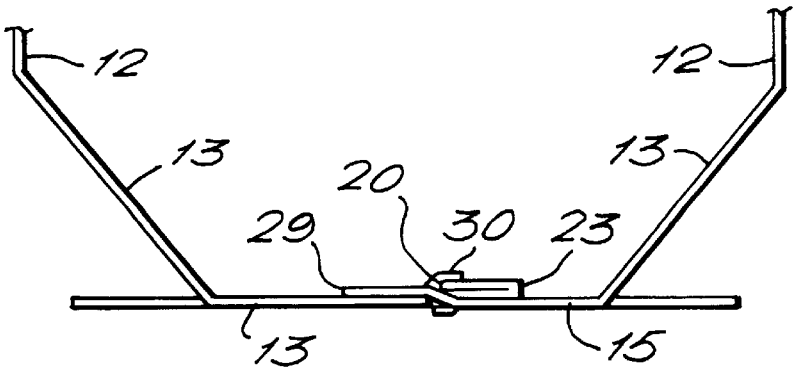
FIG. 4 is a partial schematic end view of the assembled interlocking arrangement of FIG. 3.
Figure 5:
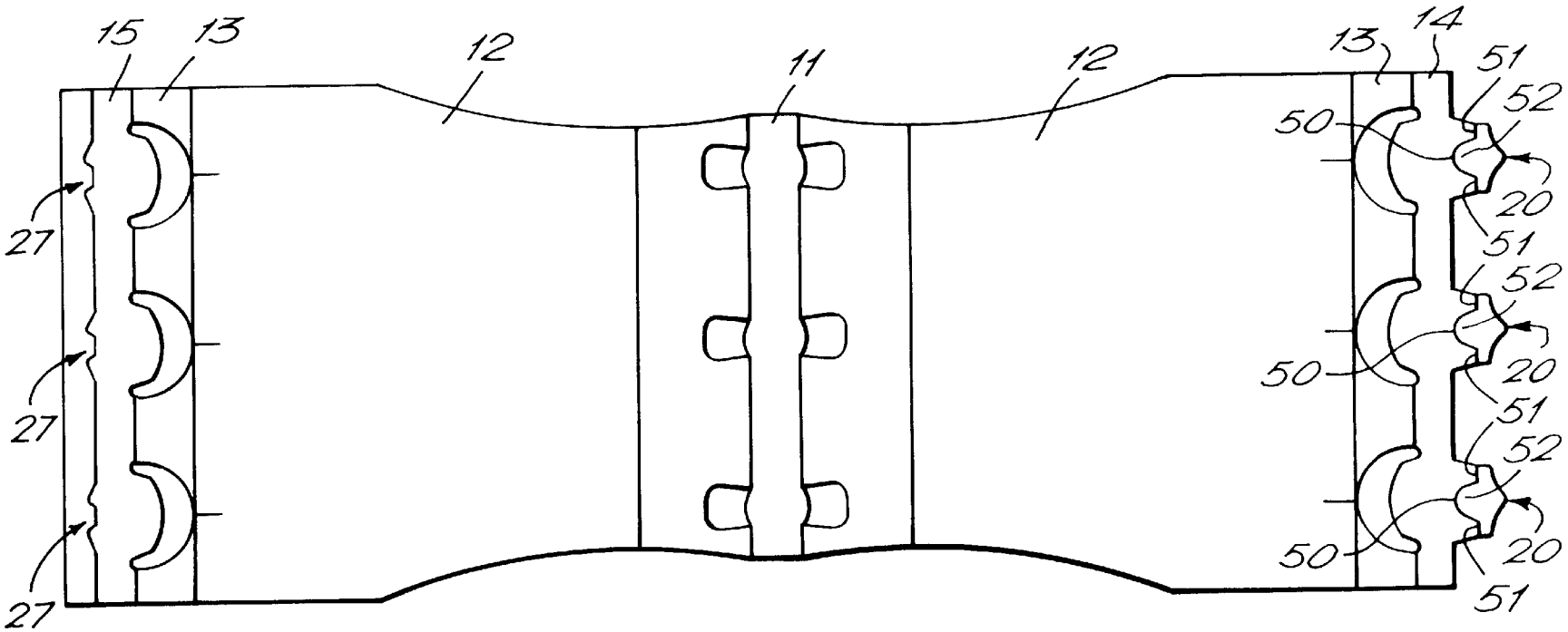
FIG. 5 is a plan view of a second carton blank incorporating another interlocking arrangement according to the present invention.
Figure 6A:
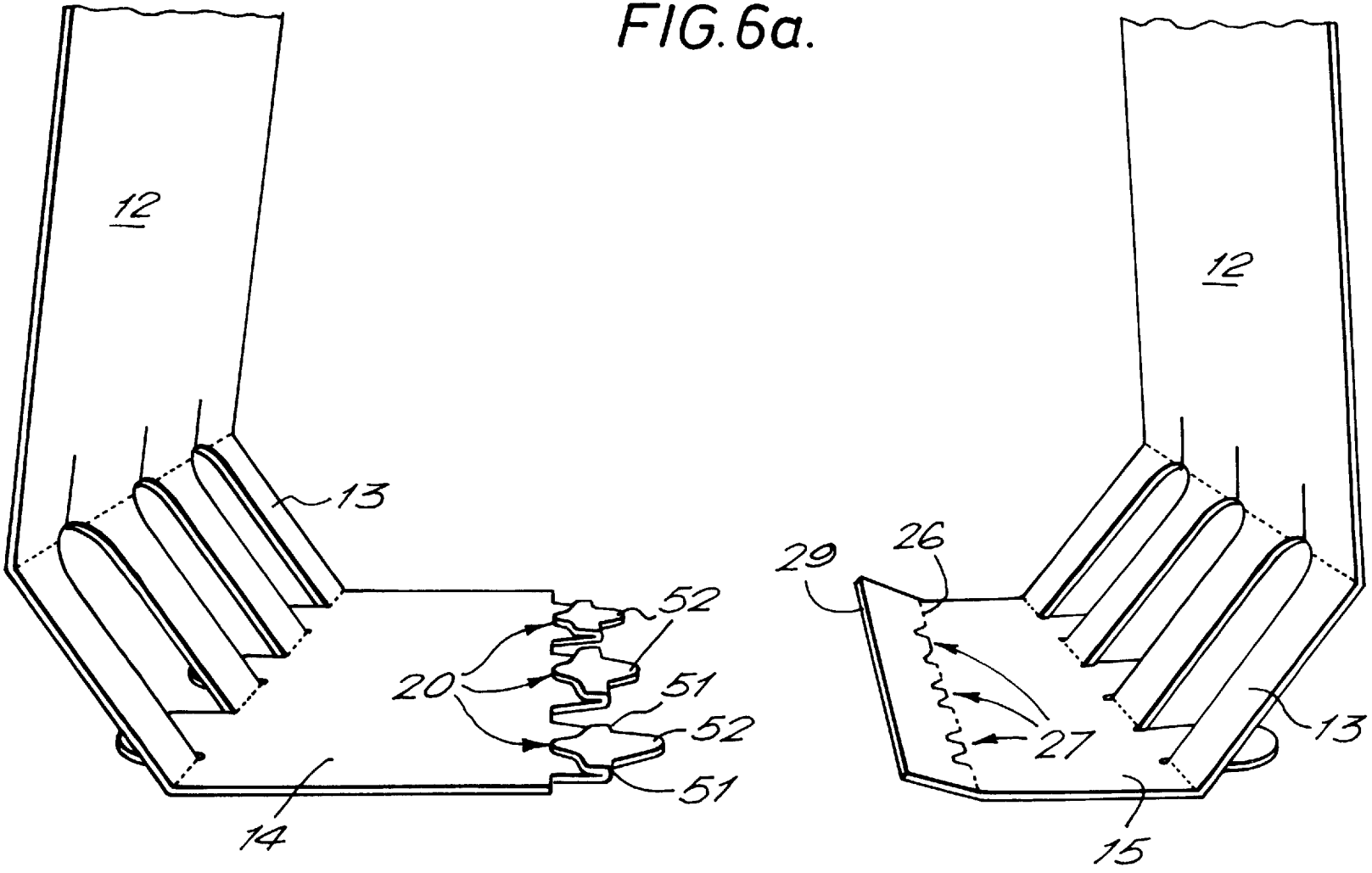

In the second embodiment shown in FIGS. 5 and 6, most features are the same as those in FIGS. 1 to 4 and so have been given like reference numerals. The principal difference is that the waist hinge 23 on the flap 19 is not continuous but has a C-shaped cut 50 made centrally between two spaced end folds 51. When the leading portion 20 is folded back the tab 52 inside the C-shaped cut 50 projects forwardly of the hinge folds 51. When the flap 19 is interconnected with the opening 27, the tab 52 remains projecting forwardly. The article held at the location of the tab 52 tends to press down on the tab thereby tending to encourage the laterally projecting portions 21 to raise further so as to strengthen the engagement with the ends 28 of the opening 27.

It will be appreciated that the shapes and dimensions discussed above are examples of suitable arrangements. Other pack sizes are of course equally suitable and it is also possible that the interlock could be provided on any paperboard article not necessarily cartons for multipacks.

While preferred embodiments of the invention have been disclosed in the foregoing specification, it is understood by those skilled in the art that variations and modifications thereof can be made without departing from the spirit and scope of the invention, as set forth in the following claims. Moreover, the corresponding structures, materials, acts, and equivalents of all means or step plus function elements in the claims are intended to include any structure, material, or acts for performing the functions in combination with other claimed elements, as specifically claimed herein.

I claim:

1. An interlocking arrangement for connecting a first base panel of a wrap type paperboard carton blank to a second base panel, the base panels being hingedly connected to the carton blank and being spaced from and opposed to one another, said interlocking arrangement comprising:

at least one flap projecting from the first base panel for cooperation with a respective opening defined in the second base panel;

said at least one flap having a leading portion spaced farthest from the first base panel, and at least one laterally projecting portion behind said leading portion;

said leading portion and said at least one laterally projecting portion of said at least one flap being folded back together onto a remaining portion of said at least one flap;

wherein said at least one flap is sized and shaped so that when it is inserted into its associated opening said at least one laterally projecting portion is passed through the opening and is moved into a position clear of the edge of the opening to prevent withdrawal of said at least one flap from the opening while the leading portion remains held flat against said remaining portion by the opening.

2. The interlocking arrangement of claim 1, wherein said at least one flap has two laterally projecting portions extending in opposite directions, said at least one flap having a waist section positioned immediately behind said laterally projecting portions, said at least one flap being folded onto said remaining portion along a score line at said waist section.

3. The interlocking arrangement of claim 2, wherein said opening comprises a single cut having two spaced ends.

4. The interlocking arrangement of claim 3, wherein said laterally projecting portions are constructed and arranged to be angled with respect to the waist section and the leading portion of said at least one flap.

5. The interlocking arrangement of claim 4, wherein said laterally projecting portions have a width of substantially the same width as said opening.

6. The interlocking arrangement of claim 5, wherein the ends of said opening are angled in a manner corresponding to the angle of the laterally projecting portions with respect to the leading portion when said leading portion and said laterally projecting portions are folded back onto said remaining portion.

7. The interlocking arrangement of claim 6, wherein said at least one flap is sized and shaped such that when said at least one flap is folded over onto said remaining portion and inserted into said opening, said leading portion does not extend into said opening.

8. The interlocking arrangement of claim 1, wherein at least two of said flaps are provided on the first base panel of the carton blank, and at least two of said openings are provided on the second base panel of the carton blank.

9. The interlocking arrangement of claim 8, wherein the second base panel includes a free end portion hingedly attached thereto along a fold line, and wherein said at least two openings are each aligned along said fold line such that the free end portion of the second base panel hinges about said fold line for assisting in the insertion of the flaps into the openings, respectively.

10. The interlocking arrangement of claim 9, wherein said fold line along each of said at least two openings comprises two spaced end sections joined by an elongate C-shaped cut extending away from said free end section for each said opening so that when said free end portion is folded along said fold line, a tab projects forwardly of the fold line for each said opening.

11. A paperboard carton blank for use in interlocking a wrap-type paperboard carton into a packaging container for holding articles therein, said carton blank comprising:

a top panel;

a first side panel hingedly connected to said top panel, and a first base panel hingedly connected to said first side panel;

a second side panel hingedly connected to said top panel, said second side panel being spaced from and opposed to said first side panel, and a second base panel hingedly connected to said second side panel;

said first base panel including at least one flap formed along a base panel side edge opposite said first side panel;

said at least one tab having:

a first side edge and a spaced second side edge, both of said side edges extending away from said base panel side edge and toward one another;

a waist section extending from said first flap side edge to said second flap side edge defining a first flap section thereby, said waist section having a waist score line of a first flap width extending from said first side edge to said second side edge;

a third side edge and a spaced fourth side edge extending away from said waist section and from one another;

a leading edge extending from said third side edge to said fourth side edge and defining a second flap section hingedly connected to said first flap section along said waist score line; and a first laterally projecting portion formed along said third side edge and a second laterally projecting portion formed along said fourth side edge, said laterally projecting portions extending opposite of one another and defining a second flap width greater than said first flap width;

a score line defined in said second base panel and being spaced intermediate the hinged connection of said second base panel to said second side panel and a free edge opposite the second side panel;

at least one slotted opening defined in said second base panel along said score line, said opening having a width substantially the same as said second flap width, said slotted opening being sized and shaped to receive said at least one flap therein.

12. The carton blank of claim 11, wherein said second flap section is folded along said waist score line over and onto said first flap section and then inserted into said opening.

13. The carton blank of claim 12, wherein said second flap section remains folded on said first flap section.

14. The carton blank of claim 11, wherein said second flap section is folded along said waist score line over and onto said first flap section and wherein said laterally projecting portions are inserted into and passed through said opening so that said leading edge does not pass through said opening and said first flap section remains folded on said second flap section.

15. The carton blank of claim 14, wherein said second flap section is constructed and arranged to be urged away from said first flap section once said laterally projecting portions have been passed through said opening for holding said at least one flap within said opening.

16. The carton blank of claim 11, wherein said at least one opening comprises an elongate central portion extending at least partially along the score line in the second base panel, and a first and a spaced second lateral end formed at the opposite ends, respectively, of said central section, said lateral ends first being angled outwardly away from, and then being angled inwardly toward said score line.

17. The carton blank of claim 16, wherein said at least one opening has a length from said first lateral end to said second lateral end greater than said second flap width for allowing said laterally projecting portions to be passed therethrough.

18. A method of assembling a paperboard carton blank into an interlocked wrap-type carton for holding articles therein, the carton blank having a top panel, a first side panel and a spaced and opposed second side panel each of which is hingedly connected to the top panel, with a first base panel hingedly connected to the first side panel and a second base panel hingedly connected to the second side panel, said method comprising the steps of:

folding the first base panel along a first fold line and folding the second base panel along a second fold line;

folding a first portion of at least one flap formed along a side edge of the first base panel opposite the first side panel over onto a second portion of said at least one flap along a waist score line;

folding the second base panel along a score line so that a free end of the second base panel opposite the second side panel is angled with respect to the remainder of the second base panel, and at least partially opening at least one slotted opening defined in the second base panel along said score line in response thereto, said opening having a width substantially the same as the width of the at least one flap and being sized and shaped to receive said at least one flap therein;

bringing the first base panel and the second base panel together and inserting said at least one flap into said at least one slotted opening; and passing a pair of opposed laterally projecting portions formed as a part of said flap and opposed to one another through said at least one opening and urging said first portion of the at least one flap away from the second portion thereof in response thereto while holding a leading edge of the first portion of said flap folded against the second portion of said flap, and holding the base panels of the carton blank together in interlocked relationship in response thereto.

* * * * *